US005481787A

United States Patent [19]

Sano et al.

[11] Patent Number: 5,481,787

[45] Date of Patent: Jan. 9, 1996

[54] APPARATUS FOR TREATING YARN WITH FLUID

[75] Inventors: Takao Sano, Moriyama; Teruaki Saijo, Otsu, both of Japan

[73] Assignee: Toray Industries, Inc., Tokyo, Japan

[21] Appl. No.: 114,163

[22] Filed: Sep. 1, 1993

[30] Foreign Application Priority Data

Sep. 4, 1992 [JP] Japan ..... 4-236921
Oct. 27, 1992 [JP] Japan ..... 4-288358

[51] Int. Cl.[6] ..... D02G 1/16

[52] U.S. Cl. ..... 28/276; 28/271

[58] Field of Search ..... 28/271, 272, 273, 28/274, 275, 276, 283

[56] References Cited

U.S. PATENT DOCUMENTS

| | | | |
|---|---|---|---|
| 2,985,995 | 5/1961 | Bunting et al. . | |
| 3,115,691 | 12/1963 | Bunting, Jr. et al. . | |
| 3,262,179 | 7/1966 | Sparling . | |
| 3,750,242 | 8/1973 | Lloyd et al. | 28/276 |
| 3,751,775 | 8/1973 | Psaras | 28/276 |
| 3,936,577 | 2/1976 | Christini et al. . | |
| 4,035,883 | 7/1977 | Bond | 28/276 |
| 4,633,550 | 1/1987 | McAliley et al. . | |

FOREIGN PATENT DOCUMENTS

| | | | |
|---|---|---|---|
| 58-169537 | 10/1983 | Japan . | |
| 58-174637 | 10/1983 | Japan . | |
| 59-66532 | 4/1984 | Japan . | |
| 61-194243 | 8/1986 | Japan . | |
| 5-503963 | 6/1993 | Japan . | |
| 0992619 | 1/1983 | U.S.S.R. | 28/276 |

*Primary Examiner*—C. D. Crowder
*Assistant Examiner*—Larry D. Worrell, Jr.
*Attorney, Agent, or Firm*—Birch, Stewart, Kolasch & Birch

[57] ABSTRACT

An apparatus for treating yarn with fluid designed to provide a yarn, which consists of a multifilament, with coherence by using a working fluid. The apparatus is provided with first and second components which have flat surfaces fixed in parallel against each other with a gap G (mm) provided between them, the first component having at least two fluid conduits which are provided with a specified crossing angle (θ) so that they cross each other on the extended lines of their axes and which are opened in the flat surface. The first and second components are fixed to satisfy the requirement in which the gap G between the flat surfaces facing each other is 0.2 mm or more but 5 mm or less, and they eject the working fluid under a specified pressure through at least the two fluid conduits onto the yarn, which runs between the flat surfaces, to provide the yarn with coherence.

17 Claims, 8 Drawing Sheets

APPARATUS FOR TREATING YARN WITH FLUID

BACKGROUND OF THE INVENTION

1. Field of the Invention

The present invention relates to an apparatus for treating as-spun or zero twist multifilament yarn with fluid which interlaces the yarn by the effect of a fluid, thus producing yarn with high coherence.

2. Description of Related Art

A yarn made of an as-spun multifilament is interlaced primarily because it has poor coherence which prevents easy handling.

In the apparatus for treating yarn with fluid designed to interlace the as-spun yarn by the effect of a fluid, the yarn to be interlaced is allowed to run between a pair of components and a fluid is ejected from one of the components, thereby periodically forming interlaced portions and opened portions, in which opened portions the filaments are separated in a spindle shape, on the yarn. Thus, the yarn will be Given the coherence, which is equivalent to that of twisted yarn, despite that the yarn has hardly any twist, or no twist.

In this case, for the interlacing to be provided on the yarn, the shorter the interlacing cycle, the higher the coherence of the yarn results.

As such a fluid-treating apparatus, those apparatuses, for example, which were disclosed in U.S. Pat. No. 3,262,179, Unexamined Japanese Patent Publication (KOKAI) No. 61-194243, U.S. Pat. No. 3,115,691, and Unexamined Japanese Patent Publication No. 59-66532, are known.

In the apparatus for interlacing multifilament yarn disclosed in the U.S. Pat. No. 3,262,179, one of two components, which provide yarn with coherence, has a spindle-shaped vortex cavity which measures in depth two to three times the gap G (mm) between the components and which has a set of fluid conduits having a crossing angle θ of 0 to 160 degrees for providing yarn with coherence and opening at the end thereof, the pitch of the fluid conduits at the opening being set at four to ten times the gap G (mm) between the components.

The fluid ejecting treating apparatus disclosed in Unexamined Japanese Patent Publication No. 61-194243 is a fluid ejecting treating apparatus which consists of a nozzle plate having a pair of fluid injection conduits and a collision plate which is provided as a counterpart thereof, the nozzle plate being provided with a concave section with a sector cross section which runs in the direction of the yarn between the pair of fluid injection conduits inclining so that they gradually move closer to each other and which has its center on the straight line perpendicular to the collision plate and has a curvature radius reaching a nozzle surface. In this fluid ejecting treating apparatus, embodiments, wherein a depth b (mm) of the concave section (round groove) having the sector cross section is set for 2.7, 3.7, and 4.7 times the diameter d (mm) of the fluid injection conduit, are disclosed.

The apparatus for interlacing multifilament yarn disclosed in the U.S. Pat. No. 3,115,691 allows yarn, which is to be interlaced, to run between a pair of components consisting of the first and second components, and a fluid is ejected from fluid conduits provided in one component toward the other component, thereby periodically forming interlaced portions and opened portions, in which opened portions the filaments are separated in a spindle shape, on the yarn.

The yarn interlacing apparatus disclosed in Unexamined Japanese Patent Publication No. 59-66532 has coherent components (9, 9') which have narrow grooves (10, 10'), through which yarn passes, provided on both ends of a collision plate (7) to prevent a fluid jet (6) from being discharged (see FIG. 5 of above document) and it is designed to forcibly interlace a false-binding point C of the yarn at the coherent components (9, 9') without being influenced by excessive or insufficient coherent force of the yarn, variations in tension applied to the yarn or dislocation of yarn (see FIG. 6 of above document).

In the apparatus for treating yarn with fluid disclosed under the U.S. Pat. No. 3,262,179 or Unexamined Japanese Patent Publication No. 61-194243, it was difficult to constantly form interlaced portions and opened portions in a regular interlacing cycle independently of the type or size of yarn by selecting an optimum shape for the two components which provide yarn with coherence. Missing interlaced portions occurred occasionally. Hence, these apparatus were not entirely satisfactory in manufacturing yarn with high interlacing property.

On the other hand, the apparatus disclosed in the U.S. Pat. No. 3,115,691 or Unexamined Japanese Patent Publication No. 59-66532 provides yarn with the same level of coherence as that of twisted yarn even though despite that the yarn has hardly any twist, or no twist; however, the fluid ejected from the fluid conduits is naturally discharged along the thread path of the yarn and no consideration is given to the discharge route in the case of the U.S. Pat. No. 3,115,691.

Hence, in the aforementioned apparatus, the discharged fluid flows along the thread path, resulting in problems. In a typical problem, the yarn, which runs between the first and second components and which is interlaced, is brought in contact with the first and second components at the incoming or outgoing point of the yarn and rubbed against them, thus causing problems such as frays or looseness of structure.

Likewise, in the case of the apparatus disclosed in Unexamined Japanese Patent Publication No. 59-66532, the coherent components (9, 9'), which are provided to prevent the discharge of the fluid jet (6), shut off the fluid discharged, disturbing the thread path of the yarn. As a result, the yarn frequently contacts the narrow grooves (10, 10') and the yarn is rubbed against them, causing problems such as frays and looseness of structure.

SUMMARY OF THE INVENTION

An object of the present invention is to provide an apparatus for treating yarn with fluid which allows yarn with high interlacing property to be produced regardless of the type or size of yarn by selecting an optimum shape for two components which furnish yarn with coherence.

Another object of the present invention is to provide an apparatus for treating yarn with fluid which suppresses the disturbance of thread path caused by a fluid for interlacing yarn, thus preventing the yarn to be interlaced from causing frays or looseness of structure, in addition to making it possible to make yarn with high interlacing property, regardless of the type or size of yarn, by selecting an optimum shape for the two components which provide yarn with coherence.

To fulfill the above-mentioned first and second objects, the inventors diligently studied the pair of components between which yarn runs in the apparatus for treating yarn with fluid for interlacing yarn.

As a result, the inventors found that, when the crossing angle of at least two fluid conduits through which a fluid is ejected and the ejection pressure of the fluid are set within given ranges, by setting a gap G between the surfaces of the pair of components facing each other, more preferably, a depth b of the concave section formed in one component and the gap G between the facing surfaces of the pair of components, to values within given ranges, an optimum extent for the treating region where yarn is interlaced by the fluid ejected from the fluid conduits can be obtained, making it possible to manufacture yarn with high interlacing property regardless of the type or size of yarn.

The inventors also found that curved portions provided on the first and second components at either the yarn incoming side or outgoing side guide the working fluid ejected from the fluid conduits by the Coanda effect and discharge the fluid in a direction away from the running direction of the yarn.

The present invention is based on these discoveries. The apparatus for treating yarn with fluid, which provides a yarn made of a multifilament with coherence by a working fluid, is provided with the first and second components having flat surfaces which face against each other in parallel with a gap G (mm) provided between them, the first component having at least two fluid conduits which are fixed tilted against the flat surface at a given crossing angle so that they cross each other on their extended axes and which are opened in the flat surface, the first and second components being set to satisfy the requirements of 0.2 mm or more but 5 mm or less for the gap G (mm) between the flat surfaces facing each other, and a working fluid being ejected under a given pressure from at least two fluid conduits toward the yarn running between the flat surfaces to provide the yarn with coherence.

Setting the gap G at a value smaller than 0.2 mm is undesirable because it causes the yarn to be processed to contact and rub against the first and second components and also prevents smooth discharge of the working fluid ejected from the fluid conduits. Likewise, setting the gap G at a value larger than 5 mm requires considerably more volume of the working fluid ejected from the fluid conduits. This would require a costly source for supplying the required volume of fluid, resulting in a failure to meet the production cost of the treating apparatus.

Preferably, the first component has a concave portion which is formed in the flat surface along its full length in the running direction of the yarn between at least two fluid conduits. The concave portion formed along the full length of the first component ensures smooth discharge of the working fluid ejected from the fluid conduits and also stable thread path for the yarn which runs between the first and second components, thus improving the periodicity of the interlaced and opened portions formed on the yarn by the interlacing process.

Also preferably, the concave portion is set such that the depth b (mm) with respect to the gap G (mm) between the flat surfaces facing against each other satisfy the relation $0.5 \leqq b/G \leqq 2.0$. If the value of b/G is smaller than 0.5 with respect to the depth b of the concave portion, then the function of the concave portion cannot be implemented; if the value of b/G is larger than 2.0, then yarn tends to stagnate at the bottom of the concave portion, ruining the interlacing periodicity. More preferably, the depth b is such that $0.5 \leqq b/G \leqq 1.5$ and most preferably, $0.7 \leqq b/G \leqq 1.3$.

Further preferably, the concave portion is a V-shaped groove. Using the V-shaped groove for the concave portion allows the V-shaped groove to be made easily with high accuracy and also causes the treating region formed between the first and second components for interlacing to become symmetrical with respect to the central line of the V groove, leading to uniform flow of the working fluid in the running direction of yarn.

Preferably, the concave portion has a width w within a range of 2 to 10 mm. If the width w of the concave portion is smaller than 2 mm, then a sufficient treating region for interlacing yarn cannot be secured. Likewise, if the width w is larger than 10 mm, then a wasteful treating region will result and a vortex will occur, disturbing the flow of the working fluid.

Preferably, at least two fluid conduits are set so that a pitch P (mm) on the flat surface of the first component satisfies the $\log_{10}De \leqq P \leqq 5\log_{10}De$, when the size of the yarn is taken as De. If the pitch P is smaller than $\log_{10}De$, then the working fluid will be emitted only partially onto the yarn, causing inadequate interlacing. If the pitch P is larger than $5\log_{10}De$, then the frequency of yarn interlacing will be reduced with resultant deterioration in the interlacing capability.

The size De of the yarn refers to the total denier of the whole yarn, i.e., the whole multifilament constituting the yarn, rather than the size of each filament constituting the yarn.

Further preferably, at least two fluid conduits have a pitch P on the flat surface of the first component set to 1 mm or more but 20 mm or less. The pitch P exceeding the range is undesirable for the same reason as described above.

Preferably, at least two fluid conduits have a diameter d of 0.5 to 3.0 mm. If the diameter d is smaller than 0.5 mm, the size of yarn which can be treated will be extremely small, making it impossible to deal with actual yarns. On the contrary, if the diameter d exceeds 3.0 mm, then more working fluid will be ejected from the fluid conduits and the utility cost and equipment cost will increase, failing to meet the production cost requirements of the treating apparatus.

Preferably, the crossing angle of at least two fluid conduits is set within a range of 60 to 160 degrees. If the crossing angle is set for an angle smaller than 60 degrees, then yarn tends to deviate from the treating region, leading to defective interlacing periodicity. On the contrary, if the crossing angle is larger than 160 degrees, then the energy loss due to the collision of the working fluid ejected from at lest two fluid conduits will increase and the interlacing performance will be deteriorated, adversely affecting the interlacing of yarn.

Preferably, the pressure of the working fluid ranges from 0.3 to 10 $kgf/cm^2$. A pressure lower than 0.3 $kgf/cm^2$ will prevent proper interlacing, while a pressure higher than 10 $kgf/cm^2$ will interfere with smooth discharge of the working fluid, suppress the vibration of yarn with resultant deterioration in the interlacing performance in addition to failing to meet the production cost of the treating apparatus.

Preferably, the first and second components are made from ceramic. There is no particular restriction on the material used for the first and second components, however, ceramic provides such advantages as improved durability, especially wear resistance and chemical resistance (lubricant resistance). Such ceramics include alumina and zirconia or the like.

To fulfill the second object, in the foregoing apparatus for treating yarn with fluid according to the present invention, the first and second components are provided with curved portions at either the yarn incoming or outgoing side, the curved portions functioning to guide the working fluid ejected from at least two fluid conduits so that it is discharged in a direction away from the running direction of the yarn.

Preferably, the curved portion has a curvature radius of 1 mm or more but 50 mm or less. If the radius of the curvature is smaller than 1 mm, then the Coanda effect, which causes the working fluid to be discharged in a direction away from the running direction of yarn while the working fluid is being guided by the curved portion, cannot be fully implemented, leading to disturbance in the thread path for the yarn. On the other hand, if the radius of the curvature exceeds 50 mm, then the discharging direction of the working fluid will be substantially the same as the running direction of the yarn, leading to disturbance in the thread path due to the working fluid. More preferably, the radius of the curved portion is set for 2 mm or more but 40 mm or less, and most preferably, 5 mm or more but 30 mm or less.

The curved portions may be provided either at the yarn incoming or outgoing side, however, they are preferably provided at the incoming side. This is because yarn tends to contact and rub against the first and second components at the incoming and outgoing point when it is subjected to the interlacing process, causing frays or looseness of structure; the influence exerted by rubbing at the incoming side is greater. Hence, it is desirable to provide the curved portions on the incoming side in order to suppress the occurrence of frays or looseness of structure. On the other hand, however, providing the curved portions at the yarn outgoing side is advantageous in that it controls the vibration of interlaced yarn and therefore controls the rubbing of the yarn against the first and second components at the outgoing side.

Preferably, the pitch P (mm) of at least two fluid conduits on the flat surface of the first component is set so that it satisfies the relation $\log_{10}De \leqq P \leqq 5\log_{10}De$ when the size of the yarn is taken as De.

Preferably, the pitch P of at least two fluid conduits on the flat surface of the first component is 1 mm or more but 20 mm or less.

Preferably, the diameter d of at least two fluid conduits ranges from 0.5 to 3.0 mm.

Preferably, the crossing angle of at least two fluid conduits ranges from 60 to 160 degrees.

Preferably, the pressure of the working fluid ranges from 0.3 to 10 $kgf/cm^2$.

Preferably, the materials of the first and second components are ceramics.

In the apparatus for treating yarn with fluid according to the present invention, the shapes of the first and second components are optimized by setting the gap G between the flat surfaces of the first and second components, the depth b of the concave portion, the diameter d of the fluid conduits, the pitch P of the fluid conduits, the crossing angle of the fluid conduits, the radius of curvature of the curved portions, and the pressure of the working fluid at values within the ranges mentioned above. This makes it possible to manufacture yarn with high interlacing property regardless of the type or size of yarn and also control the disturbance in the thread path caused by the fluid for interlacing the yarn, thus controlling frays or looseness of structure that may occur in the yarn to be interlaced.

However, the above-mentioned ranges of parameters are average ranges which are established under the condition where yarn is interlaced regardless of the type or size of yarn. In actual applications, all the parameters vary depending on many conditions, including the number and material of the multifilament constituting the yarn, the size of the whole multifilament or the size of each filament, the yarn speed when the yarn is interlaced, the treating conditions such as yarn tension, and the wax applied to the yarn. Hence, it should be noted that the specific values of all the parameters cannot be fixed uniformly.

According to the apparatus for treating yarn with fluid of the present invention, an excellent effect that enables production of yarn exhibiting high interlacing property regardless of the type or size of yarn will be provided. Moreover, the first and second components have a simple structure and permits easy machining; therefore, the manufacturing cost can be controlled to a minimum.

Further, curved portions are provided on either the yarn incoming or outgoing side of the first and second components; therefore, the fluid for interlacing yarn flows out in a direction away from the running direction of yarn, eliminating the chance of its disturbing thread path. This ensures a stable thread path and controls the occurrence of frays or looseness of structure in yarn to be interlaced, thus making it possible to properly interlace the yarn.

The above and other objects, characteristics, and advantages of the invention will become more apparent from the following detailed description taken in connection with the accompanying drawings. However, the following Brief Description of the Drawings and Detailed Description of the Preferred Embodiments are not to be construed as limiting the invention.

BRIEF DESCRIPTION OF THE DRAWINGS

.

DETAILED DESCRIPTION OF THE PREFERRED EMBODIMENTS

To manufacture yarn featuring high interlacing property regardless of the type or size of yarn, which is the first object of the invention, the apparatus for treating yarn with fluid according to the present invention has, as shown in FIG. 1 through FIG. 4, a nozzle plate 1, which is the first component, and a presser plate 2, which is the second component, both plates being located in parallel facing against each other with a prescribed gap G (mm) provided between flat surfaces 1*a* and 2*a*. Both plates 1 and 2 are made of a ceramic, such as alumina or zirconia.

The nozzle plate 1 has fluid conduits 1*b* which are fixed inclined against the flat surface 1*a* with a specified crossing angle θ so that they cross each other on their extended axes and which are opened in the flat surface 1*a*, and a concave portion, e.g., a V groove 1*c*, which is formed along the running direction of yarn T at the center of the flat surface 1*a* in which the fluid conduits 1*b* are opened.

Figure 1:
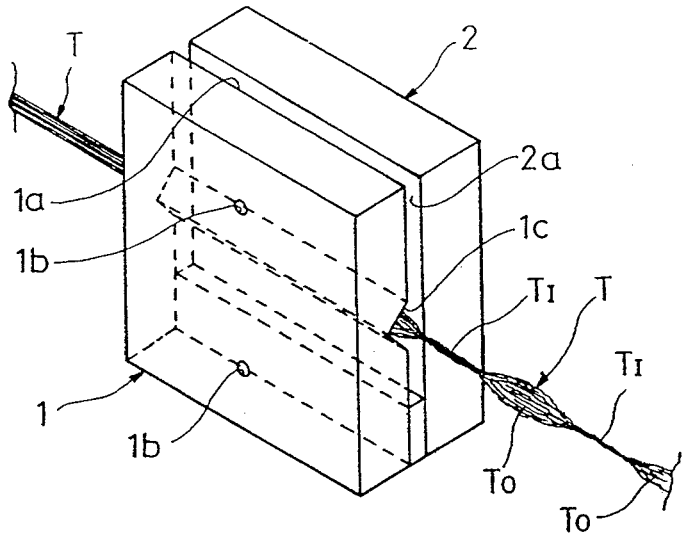
FIG. 1 is a perspective view of an apparatus for treating yarn with fluid for fulfilling the first object of the present invention.

In the aforementioned apparatus for treating yarn with fluid, as shown in FIG. 1, an opened portion $T_O$ where the filaments are separated in a spindle shape and an interlaced portion $T_I$ where the multifilament is interlaced will be formed successively at regular intervals on the yarn T to be interlaced.

Figure 2:
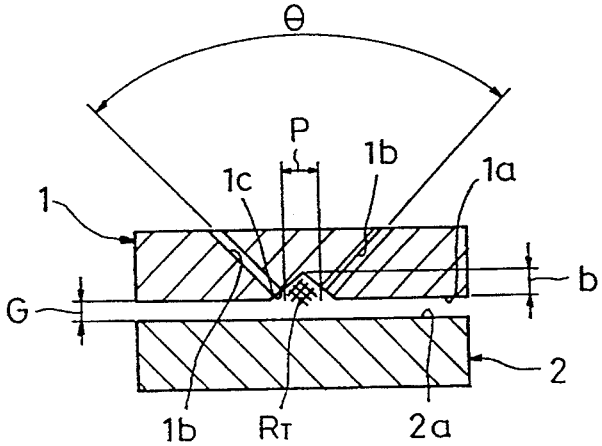
FIG. 2 is a cross-sectional view of the apparatus for treating yarn with fluid shown in FIG. 1.
Figure 3:
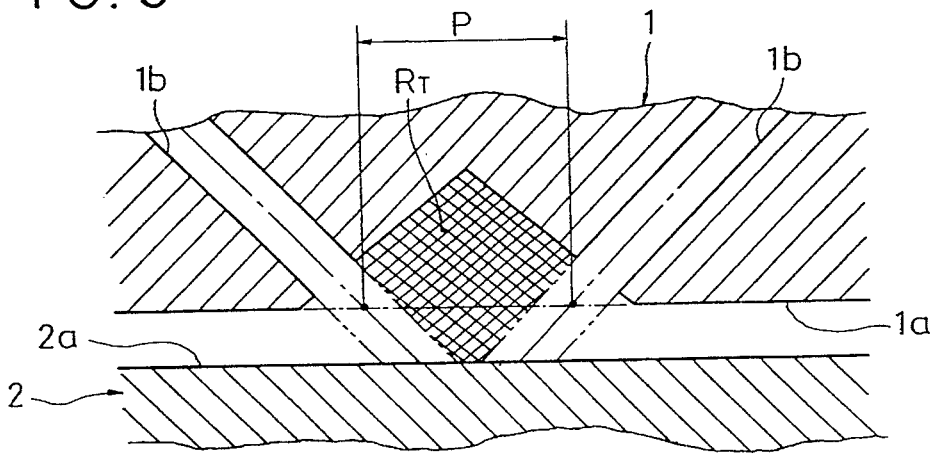
FIG. 3 is an enlarged cross-sectional view of a treating region $R_T$ of FIG. 2.
Figure 4:
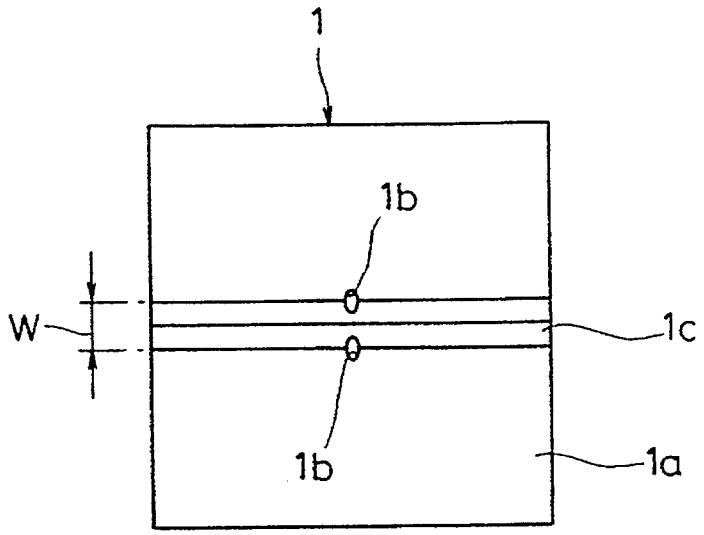
FIG. 4 is a plan view which illustrates a nozzle plate of the apparatus for treating yarn with fluid shown in FIG. 1.

In this case, if the concave portion formed in the nozzle plate 1 of the apparatus for treating yarn with fluid is the V groove 1*c* as described above, then the yarn T is interlaced in a treating region $R_T$, as shown by the hatched area in FIG. 2 and FIG. 3.

The treating region $R_T$ refers to the region enclosed by the surface of the V groove 1*c*, the extended lines of the inner surfaces of a pair of the fluid conduits 1*b* and the surface of the plate 2 as shown in FIG. 3.

The yarn T exhibits a two-dimensional behavior in the treating region $R_T$ and it is interlaced by the fluid ejected from one of the fluid conduits 1*b* while it is running between the plates 1 and 2. The two-dimensional behavior of the yarn T in the treating region $R_T$ increases the frequency of interlacing and thus enhances the interlacing property of the yarn T; therefore, the extent of the treating region $R_T$ is an important factor which determines the performance of interlacing the yarn T.

As the working fluid ejected from the fluid conduits 1*b*, compressed air, for instance, supplied from a compressed air supplying source, not shown, is used.

In the apparatus for treating yarn with fluid according to the present invention, the shape of the opened portion $T_O$ in which the filaments are separated in the spindle shape and which is formed on the yarn T by the interlacing process is determined by the concave portion, more specifically, the depth b (mm) of the V groove 1*c*, the gap G (mm) between both plates, and the pitch P (mm) of the fluid conduits 1*b* shown in FIG. 2 and FIG. 3 if the crossing angle θ of the fluid conduits 1*b* and the pressure of the working fluid are fixed.

In this case, the depth b of the concave portion, i.e., V groove 1*c*, varies depending on the type, size and the like of the yarn to be interlaced, however, it is set so that it satisfies the relation $0.5 \leqq b/G \leqq 2.0$, more preferably $0.5 \leqq b/G \leqq 1.5$, and most preferably $0.7 \leqq b/G \leqq 1.3$ Also, the size of the opened portion $T_O$ varies according to the size De of the yarn T. The size De is one of the factors which determine the pitch P of the fluid conduits 1*b* as described above.

The nature of the present invention is further illustrated by the following examples, which are not to be construed as limiting the present invention.

EXAMPLE 1

In the apparatus for treating yarn with fluid shown in FIG. 1 through FIG. 4, the depth b of the V groove 1*c* of the nozzle plate 1 was set to 0.7 mm, the pitch P of the fluid conduits 1*b* in the flat surface 1*a* was set to 4.5 mm, the crossing angle θ of the fluid conduits 1*b* and 1*b* was set to 90 degrees, the diameter d of each fluid conduit 1*b* was set to 1.0 mm, and the width w of the V groove 1*c* was set to 4.0 mm, the gap G between the two plates 1,2 being set to six different values within the range of 0.3 to 1.8 mm. A yarn, which consists of 48 Tetoron filaments and which has 150 deniers as its total denier value, was passed between the two plates at a yarn speed of 1,000 m/min. and with a 20 gf yarn tension and the yarn was interlaced while compressed air having a pressure of 4 kgf/cm$^2$ was ejected through the fluid conduits 1*b*. The CN (Cohesion Number) value, which is the index of the number of interlacings per unit length, was measured on the obtained yarn.

The results are shown in Table 1 which gives b/G, i.e., the ratio of depth b of the V groove 1*c* to the gap G between the two plates 1,2, the gap G between the two plates, and the CN values.

TABLE 1

| b/G | 0.39 | 0.50 | 0.88 | 1.17 | 1.75 | 2.33 |
|---|---|---|---|---|---|---|
| G | 1.8 | 1.4 | 0.8 | 0.6 | 0.4 | 0.3 |
| CN value | 18.8 | 21.2 | 22.6 | 27.2 | 26.8 | 15.1 |

Based on the relationship shown in Table 1 above, the ratio b/G was taken on the x-axis and the CN value on the y-axis to graph the relationship between the two. The graph has revealed that there is the relationship shown in FIG. 5 between the ratio b/G and the CN value.

Then, the CN values were measured using Entanglement Tester Type R2050 (manufactured by Rothschild Co., Switzerland). For the measurement, a pretension $T_{PR}$ was applied to the yarn which ran at a speed of 10 cm/sec., and the number of times when a trip tension $T_{TR}$ was actuated during a period wherein the yarn ran for 10 m was measured. Based on the number of times, the number of interlacings per 1-meter yarn was determined, and the number was taken as the CN value (No./m).

The pretension $T_{PR}$ and the trip tension $T_{TR}$ are given by the following formula, taking the size of the yarn, i.e., total denier, as De, and the number of filaments constituting the yarn as f:

$$T_{PR}=De/5 \text{ (gf)}$$

$$T_{TR}=\{(De/5)+(De/f)\}(gf)$$

Further, the pretension $T_{PR}$ and the trip tension $T_{TR}$ were set as shown below according to the type of yarn, taking the size of the yarn as De and the number of filaments constituting the yarn as f:

| Type of Yarn | Pretension $T_{PR}$ | Trip Tension $T_{TR}$ |
|---|---|---|
| 75De –36f | 15 | 17 |
| 150De –30f | 30 | 35 |
| 150De –48f | 30 | 33 |
| *1000De –72f | 40 | 50 |

In the case of the yarn of 1000De–72f, the pretension $T_{PR}$ could not be set higher than 100 gf; therefore, empirical values were used.

Figure 5:
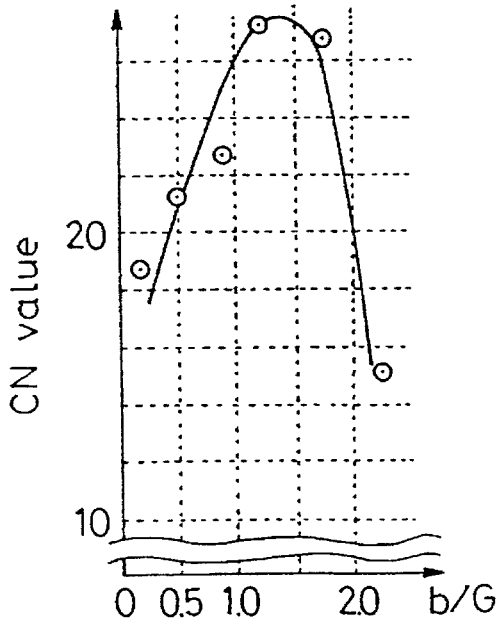
FIG. 5 is a characteristic diagram which shows the relationship between the CN value, which is an index of the number of interlacings per unit length and a ratio of b/G of a depth b of a concave portion to a gap G between both plates, when yarn is interlaced using the apparatus for treating yarn with fluid shown in FIG. 1.

Hence, as it is obvious from the relationship shown in Table 1 and FIG. 5, the interlacing property of yarn improves when the depth b of the V groove 1*c* is set so that it satisfies the requirement that the ratio b/G of the depth b to the gap G between the two plates is $0.5 \leqq b/G \leqq 2$.

EXAMPLE 2

In the apparatus for treating yarn with fluid shown in FIG. 1 through FIG. 4, the depth b of the V groove 1*c* of the nozzle plate 1 was set to 0.7 mm, the pitch P of the fluid conduits 1*b* in the flat surface 1*a* was set to 4.0 mm, the crossing angle θ of the fluid conduits 1*b* was set to 120 degrees, the diameter d of each fluid conduit 1*b* was set to 1.0 mm, and the width w of the V groove 1*c* was set 4.0 mm, the gap G between the two plates 1,2 being four different values within the range of 0.38 to 1.34 mm. Different types of yarn were subjected to the interlacing process under the same conditions as those used for Example 1, and the CN values of the acquired yarns were measured.

In this case, POY (pre-oriented yarn), the total denier De after drawing thereof is 150 and the number of filaments f thereof is 30, was used.

The results are shown in Table 2 which gives b/G, i.e., the ratio of depth b of the V groove 1*c* to the gap G between the two plates, the gap G between the two plates, and the CN values.

TABLE 2

| | | | | |
|---|---|---|---|---|
| b/G | 0.52 | 0.93 | 1.49 | 1.84 |
| G | 1.34 | 0.75 | 0.47 | 0.38 |
| CN value | 4.0 | 4.8 | 4.0 | 0.8 |

Based on the relationship shown in Table 2 above, the ratio b/G was taken on the x-axis and the CN value on the y-axis to graph the relationship between the two. The graph has revealed that there is the relationship shown in FIG. 6 between the ratio b/G and the CN value.

Figure 6:
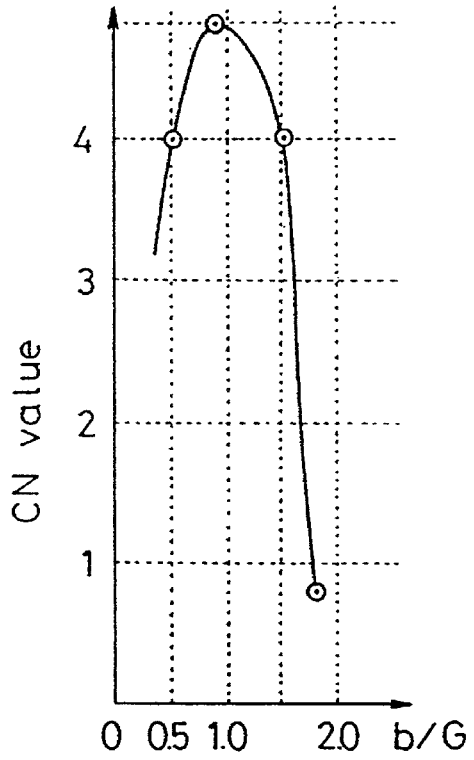
FIG. 6 is a characteristic diagram which shows the relationship between the CN value and the ratio b/G acquired with different dimensions in the apparatus for treating yarn with fluid shown in FIG. 1 and different types of yarn.

Hence, as is clear from the relationship shown in Table 2 and FIG. 6, the interlacing property of yarn improves regardless of the type of yarn when the depth b of the V groove 1*c* is set so that it satisfies the requirement that the ratio b/G of the depth b to the gap G between the two plates is $0.5 \leqq b/G \leqq 2$, especially $0.5 \leqq b/G \leqq 1.5$.

EXAMPLE 3

Comparative Examples 1 and 2

In the apparatus for treating yarn with fluid shown in FIG. 1 through FIG. 4, the depth b (mm) of the V groove 1*c* of the nozzle plate 1, the gap G (mm) of the two plates 1,2, the pitch P (mm) of the fluid conduits 1*b* in the flat surface 1*a*, the crossing angle θ (°) of the fluid conduits 1*b*, each diameter d (mm) of the fluid conduit 1*b*, and the width w (mm) of the V groove 1*c* were set as shown in Table 3 below:

TABLE 3

| | Ex. 3 | Com. 1 | Com. 2 | Ex. 4 | Com. 3 | Com. 4 |
|---|---|---|---|---|---|---|
| b | 1.0 | 1.0 | 1.0 | 1.0 | 1.0 | 1.0 |
| G | 1.0 | 0.4 | 0.4 | 1.0 | 1.0 | 0.4 |
| P | 2.5 | 2.5 | 2.5 | 6.0 | 6.0 | 6.0 |
| θ | 90° | 90° | 90° | 120° | 120° | 120° |
| d | 1.0 | 1.0 | 1.0 | 2.0 | 2.0 | 2.0 |
| w | 3.5 | 3.5 | 3.5 | 6.0 | 6.0 | 6.0 |

Ex.: Example
Com.: Comparative Example

Under the setting conditions shown above, the yarn consisting of 48 Tetoron filaments and having a total denier of 150 was passed between the two plates at a yarn speed of 1000 m/min. and under a yarn tension of 15 gf, and the yarn was interlaced while compressed air of 4 kgf/cm$^2$ was being ejected through the fluid conduits 1*b*. The CN values of the acquired yarn were measured. The results are shown in Table 4 which also gives the ratio b/G of the depth b of the V groove 1*c* to the gap G between the two plates and the CN values.

Figure 7:
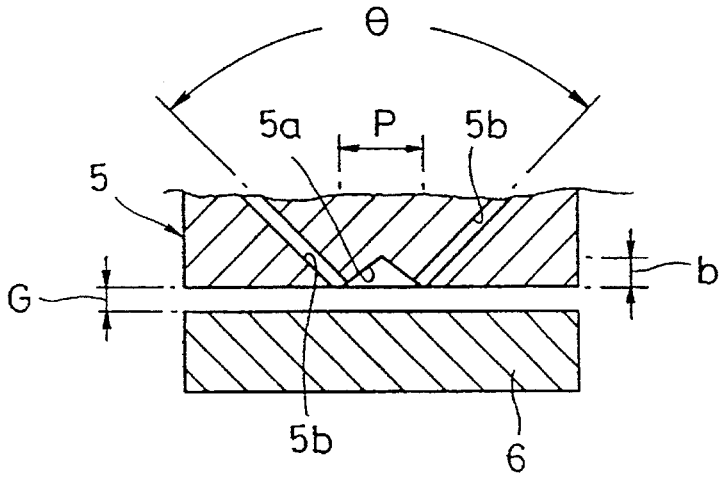
FIG. 7 (PRIOR ART)
FIG. 7 is a cross-sectional view which shows the apparatus for treating yarn with fluid according to comparative example 1.
Figure 8:
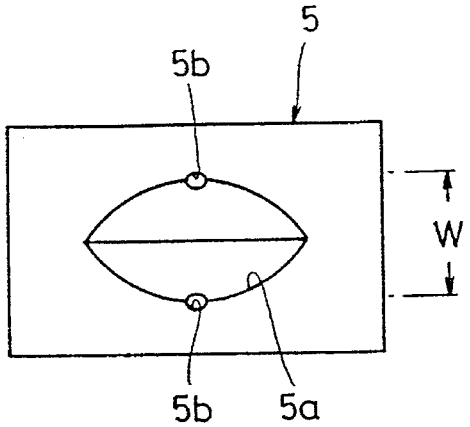
FIG. 8 (PRIOR ART)
FIG. 8 is a plan view of a component wherein a spindle-shaped vortex cavity is formed in the apparatus for treating yarn with fluid according to comparative example 1.

Further, for the purpose of comparison, in the components 5 and 6 shown in FIG. 7 and FIG. 8 which are attached to this specification and which correspond to the apparatus for treating yarn with fluid disclosed in the U.S. Pat. No. 3,262,179, a spindle-shaped vortex cavity 5*a* was formed, and the dimensions of the component 5 having fluid conduits 5*b*, which dimensions correspond to those in the present invention, were set as shown in Table 3. Under the same treating conditions, the same type of the yarn mentioned above was subjected to the interlacing process.

Figure 9:
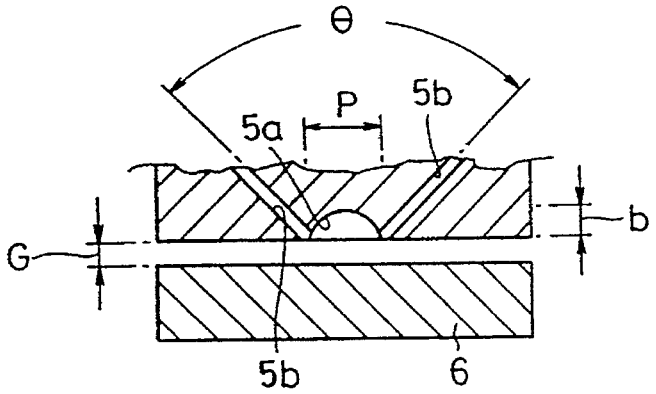
FIG. 9 (PRIOR ART)
FIG. 9 is a cross-sectional view which shows the apparatus for treating yarn with fluid according to comparative example 2.

In this case, for the vortex cavity 5*a*, a V groove shown in FIG. 7 accompanying this specification and a round groove 5*c* shown in FIG. 9 were used. The case wherein the V groove shown in FIG. 7 was used is taken as Comparative Example 1, while the case wherein the round groove 5*c* shown in FIG. 9 was used is taken as Comparative Example 2.

The results are shown in Table 4 which also indicates the ratio b/G of the depth b of the V groove 1*c* to the gap G between the two plates and the CN values.

TABLE 4

| | Example 3 | Comparative Ex. 1 | Comparative Ex. 2 |
|---|---|---|---|
| b/G | 1.0 | 2.5 | 2.5 |
| CN value | 13.5 | 9.0 | 5.0 |

As is clear from the results shown in Table 4, in the apparatus for treating yarn with fluid according to the present invention, setting the ratio b/G so that it satisfies the requirement of $0.5 \leqq b/G \leqq 2$ ensures stable flow of the compressed air ejected through the fluid conduits 1*b* and allows yarn with high interlacing property to be produced independently of the type or size of yarn.

Further, during the interlacing process, in Comparative Example 2, it was found that the yarn jumps out from the treating region formed by the fluid conduits 5b and the components 5,6, in a direction which crosses with the running direction of the yarn at right angle.

EXAMPLE 4

Comparative Examples 3 and 4

The interlacing performance of the apparatus for treating yarn with fluid according to the present invention was compared with that of the apparatus for treating yarn with fluid disclosed in Unexamined Japanese Patent Publication No. 61-194243.

For the purpose of the comparison, in the apparatus for treating yarn with fluid according to the present invention shown in FIG. 1 through FIG. 4, the depth b (mm) of the V groove 1c of the nozzle plate 1, the gap G (mm) of the two plates 1,2, the pitch P (mm) of the fluid conduits 1b in the flat surface 1a, the crossing angle θ (°) of the fluid conduits 1b, the diameter d (mm) of each fluid conduit 1b, and the width w (mm) of the V groove 1c were set as shown in Table 3, and a yarn consisting of 72 Tetoron filaments and having a total denier of 1000 was passed between the two plates at a yarn speed of 1000 m/min. and under a yarn tension of 50 gf, and the yarn was interlaced while a compressed air of 5 $kgf/cm^2$ was ejected through the fluid conduits 1b.

Figure 10:
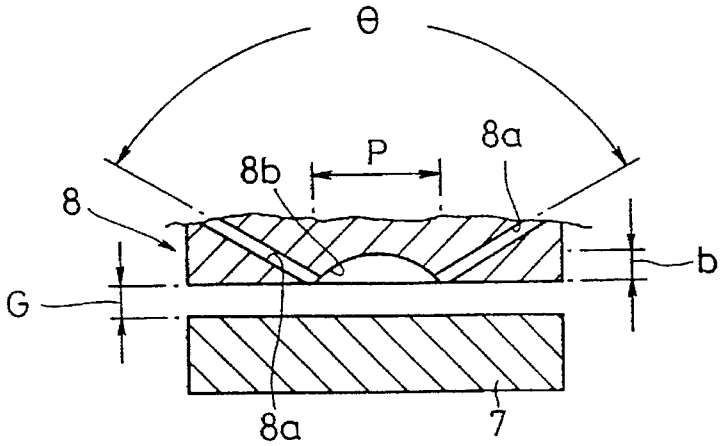
FIG. 10 (PRIOR ART)
FIG. 10 is a cross-sectional view which shows the apparatus for treating yarn with fluid according to comparative examples 3 and 4.
Figure 11:
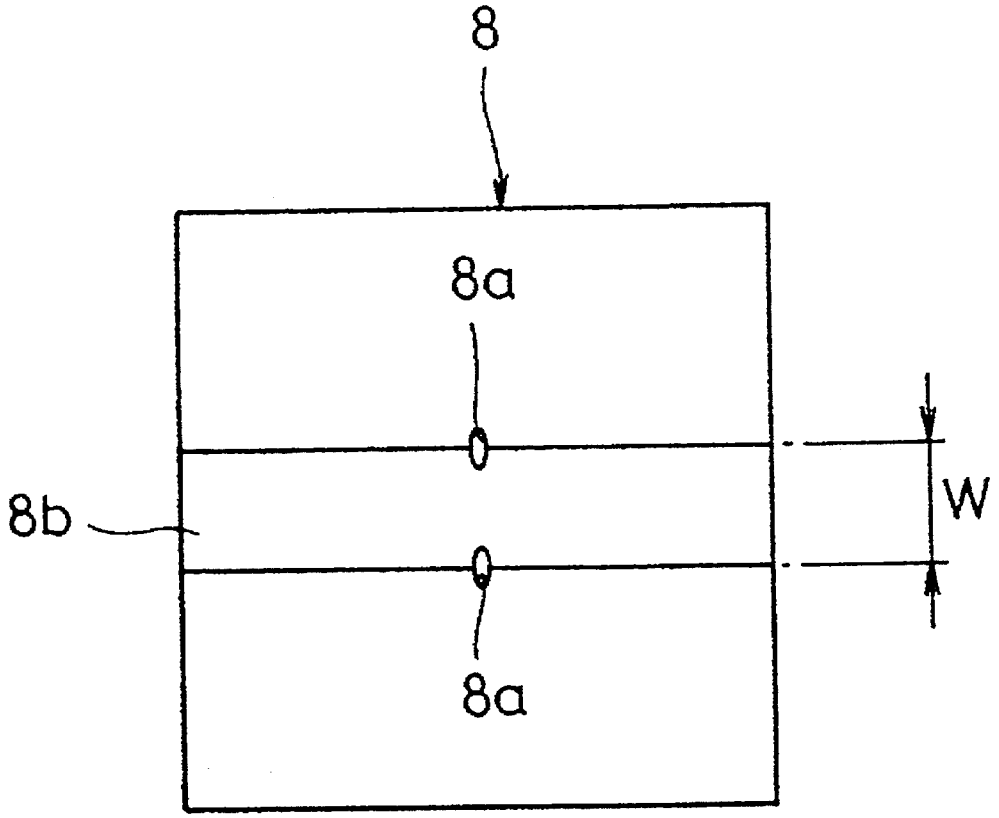
FIG. 11 (PRIOR ART)
FIG. 11 is a plan view of a nozzle plate in the apparatus for treating yarn with fluid according to comparative examples 3 and 4.

In the fluid ejecting treating apparatus disclosed in Unexamined Japanese Patent Publication No. 61-194243, as shown in FIG. 10 and FIG. 11 accompanying this specification, in a collision plate 7 and a nozzle plate 8 which has nozzle holes 8a and 8a and a concave section 8b having a sector cross section, the dimensions corresponding to those in the present invention were set as shown in Table 3. Under the same treating conditions, the same type of yarn mentioned above was subjected to the interlacing process.

In this case, in the fluid ejecting treating apparatus, the gap G between the collision plate 7 and the nozzle plate 8 was described merely as a minimum value which allows yarn to pass through; therefore, the gap G was set to 1.0 mm and 0.4 mm. The case wherein the gap G was 1.0 mm was taken as-Comparative Example 3 and the case wherein the gap G was 0.4 mm was taken as Comparative Example 4.

The results are shown in Table 5 which also indicates the ratio b/G of the depth b of the V groove 1c to the gap G between the two plates, and the CN values.

TABLE 5

| | Example 4 | Comparative Ex. 3 | Comparative Ex. 4 |
|---|---|---|---|
| b/G | 1.0 | 1.0 | 2.5 |
| CN value | 7.3 | 5.0 | 3.5 |

As is clear from the results shown in Table 5, in the apparatus for treating yarn with fluid according to the present invention, setting the ratio b/G so that it satisfies the requirement of $0.5 \leqq b/G \leqq 2$ enables production of yarn with high interlacing property.

On the other hand, the apparatus for treating yarn with fluid according to the present invention is configured as described below to fulfill the second object, i.e., to suppress the disturbance of thread path caused by the fluid which interlaces yarn and prevent frays or looseness of structure from taking place in the yarn to be interlaced, in addition to making it possible to produce yarn which provides good interlacing property regardless of the type or size of yarn.

As shown in FIG. 12 through FIG. 15, an apparatus 10 for treating yarn with fluid has a nozzle plate 11, which is the first component, and a presser plate 12, which is the second component, both plates 11,12 being located in parallel facing against each other with the gap G (mm) provided between flat surfaces 11a and 12a. Both plates 11 and 12 are made of ceramic, such as alumina or zirconia.

A concave portion 11c formed in the back surface 11b of the nozzle plate 11 has fluid conduits 11d which are fixed inclined against the flat surface 11a with a specified crossing angle θ so that they cross each other on their extended axes and which are opened in the flat surface 11a. A working fluid such as compressed air is supplied to the fluid conduits 11d from a compressed air source which is not shown.

Hence, a treating region for interlacing the yarn T is formed between the fluid conduits 11d which are located between the nozzle plate 11 and the presser plate 12.

In this case, with respect to the apparatus for treating yarn with fluid 10 illustrated in FIG. 12 through FIG. 17, the gap G between the flat surfaces 11a and 12a of the nozzle plate 11 and the presser plate 12, the diameter d of each fluid conduit 11d, the pitch P of the fluid conduits 11d in the flat surface 11a, the crossing angle θ of the fluid conduits 11d, and the pressure of the working fluid are set in the same ranges as those for the apparatus for treating yarn with fluid for fulfilling the first object of the present invention as described previously.

Figure 12:
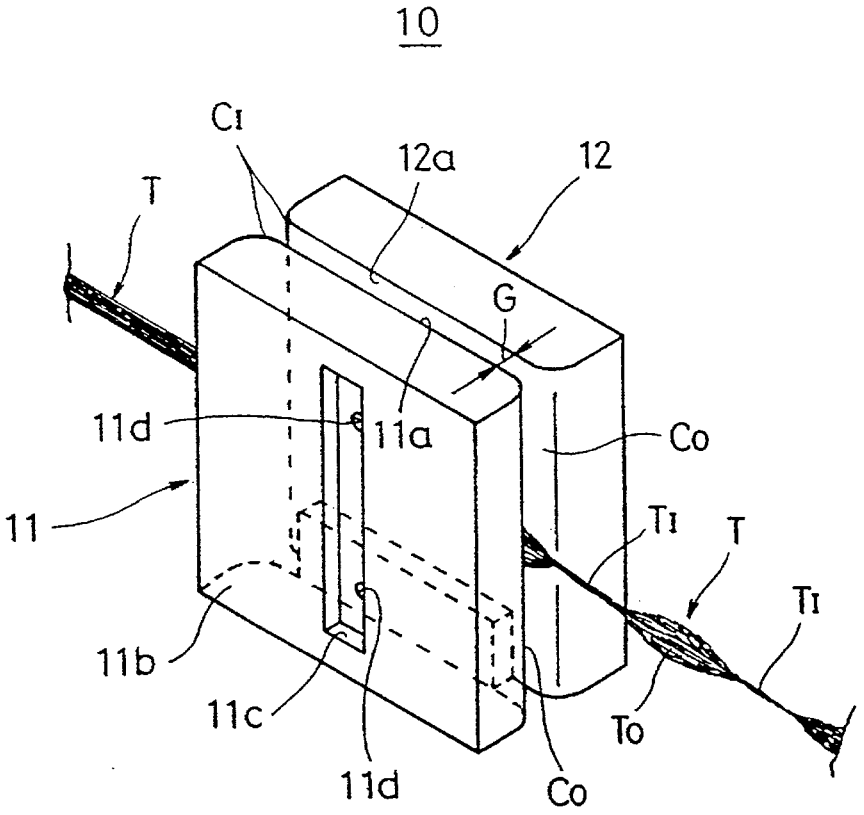
FIG. 12 is a perspective view of the apparatus for treating yarn with fluid for fulfilling the second object of the present invention.
Figure 13:
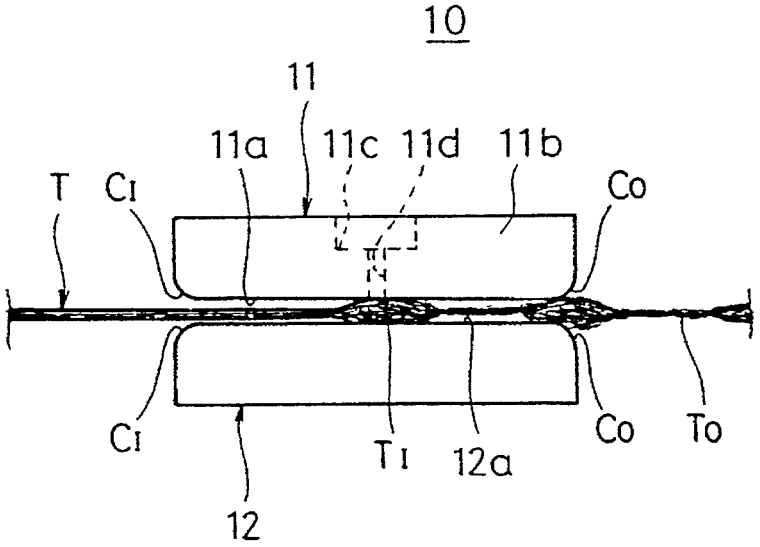
FIG. 13 is a plan view which shows the apparatus for treating yarn with fluid of FIG. 12 observed from above.
Figure 14:
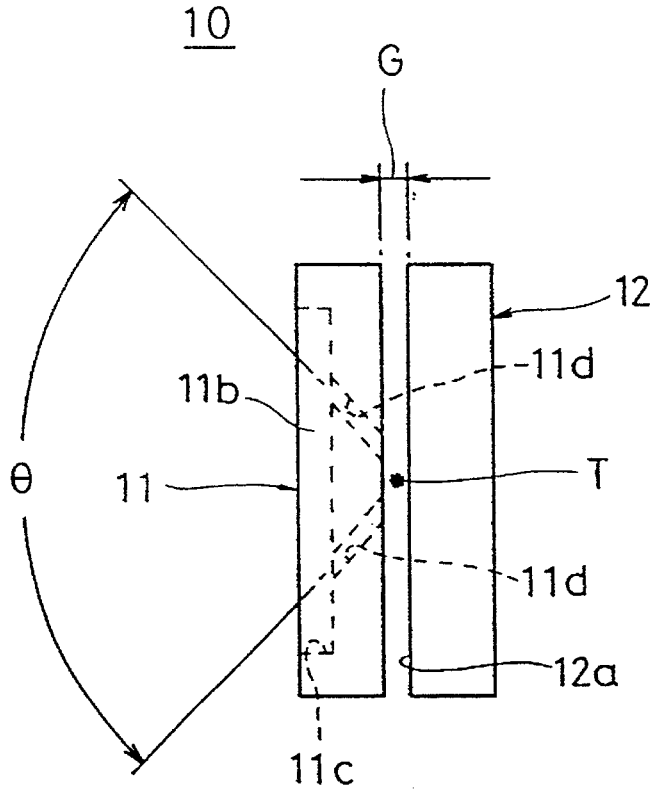
FIG. 14 is a side view which shows the apparatus for treating yarn with fluid of FIG. 12 observed from the right.

In the apparatus 10 for treating yarn with fluid, the yarn T runs between the fluid conduits 11d between the plates 11 and 12 and it is interlaced by the compressed air ejected through the fluid conduits 11d toward the flat surface 12a of the presser plate 12. Thus, the opened portion $T_O$ where the filaments are separated in the spindle shape and an interlaced portion $T_I$ are formed in succession at regular intervals on the yarn T as shown in FIG. 12.

In this case, the plates 11 and 12 of the apparatus 10 for treating yarn with fluid are provided with curved portions $C_I$ and $C_I$ on the incoming side for the yarn T and curved portions $C_O$ and $C_O$ on the outgoing side.

Figure 15:
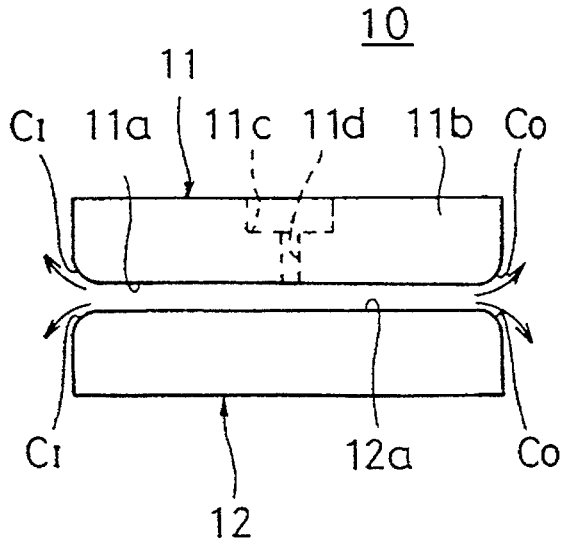
FIG. 15 is a plan view which shows the flows of compressed air ejected from the fluid conduits in the nozzle plate on the incoming and outgoing sides in the apparatus for treating yarn with fluid shown in FIG. 12.

These curved portions $C_I$ and $C_O$ function to guide the compressed air ejected through the fluid conduits 11d so that the air is discharged in a direction away from the running direction of the yarn T by making use of the Coanda effect, by which the air flows along the curvatures at the incoming and outgoing sides of the plates 11 and 12 as shown by the arrows in FIG. 15, thus ensuring stable thread path for the yarn T.

The above discussion is directed to an apparatus wherein the curved portions $C_I$ and $C_O$ are provided on both incoming and outgoing sides for the yarn T, however, such curved portions may be provided only on the incoming or outgoing side.

Figure 16:
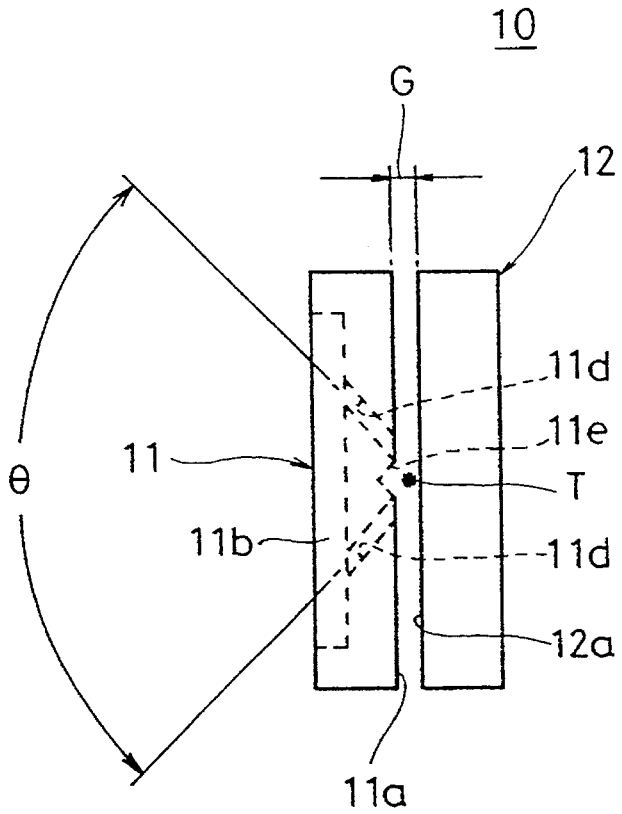
FIG. 16 is a side view which shows another embodiment of the apparatus for treating yarn with fluid with a V-shaped groove formed in the running direction of yarn.
Figure 17:
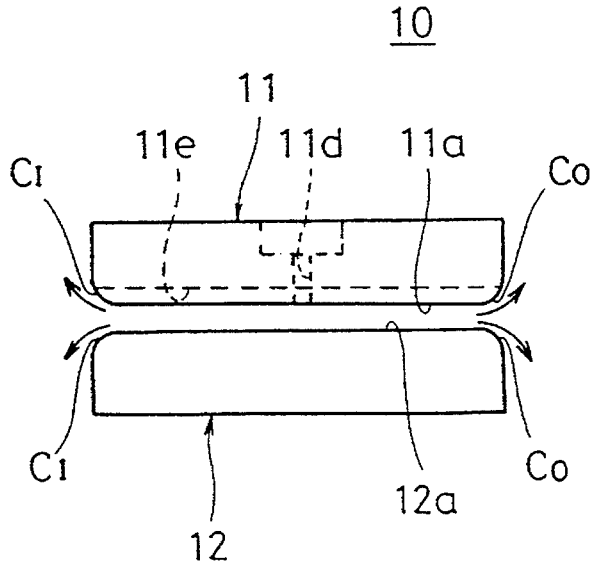
FIG. 17 is a plan view which shows the flows of compressed air ejected from the fluid conduits in the nozzle plate in the apparatus for treating yarn with fluid shown in FIG. 16.

Further, the apparatus 10 for treating yarn with fluid gives the same effect when it is provided with the nozzle plate 11 and the presser plate 12 which are located in parallel facing against each other with a specified gap G (mm) between the flat surfaces 11a and 12a, and a concave portion such as a V groove 11e which is formed, in the running direction of the yarn, between the fluid conduits 11d and 11d which are opened in the flat surface 11a of the nozzle plate 11 as shown in FIG. 16 and FIG. 17.

In this case, the V groove 11e is set so that the depth b (mm) is $0.5 \leqq b/G \leqq 2.0$ and the width w (mm) is in the range of 2 to 10 mm.

The yarn T is interlaced by the compressed air ejected through the fluid conduits 11*d* when it runs between the plates 11 and 12. At this time, the yarn T exhibits a two-dimensional behavior and it is interlaced by the fluid ejected through one of the fluid conduits 11*d*. This two-dimensional behavior of the yarn T increases the frequency of interlacing and produces a yarn with good interlacing property; therefore, it is necessary to control the discharging direction of the compressed air to prevent the thread path from being disturbed in the apparatus 10 for treating yarn with fluid.

EXAMPLES 5 TO 7

Comparative Examples 5 to 7

In the apparatus 10 for treating yarn with fluid shown in FIG. 12 through FIG. 15, the curvature radii R of the curved portions $C_I$ and $C_I$ on the incoming side of the nozzle plate 11 and presser plate 12 and the curved portions $C_O$ and $C_O$ on their outgoing sides were set for 5.0 mm, 2.0 mm, and 1.0 mm, respectively. The yarn T, POY which consists of 36 filaments and has a total denier of 75, was let run between the plates 11 and 12 at a thread speed of 3,000 m/min. and under a thread tension of 30 gf and interlaced while it was subjected to compressed air of 4 kgf/cm$^2$ ejected through the fluid conduits 11*d*.

For the purpose of comparison, an apparatus for treating yarn with fluid, the nozzle plate 11 and presser plate 12 thereof having the same dimensions but the curvature radii R of the curved portions $C_I$ and $C_I$ and curved portions $C_O$ and $C_O$ being set to 0.5 mm and 0.3 mm, and another apparatus for treating yarn with fluid, the incoming and outgoing sides of the nozzle plate 11 and presser plate 12 thereof being chamfered rather than being provided with curved portions, were prepared. Using these two different apparatuses, the POY comprising 36 filaments and a total denier of 75 was interlaced under the same treating condition as described above.

The results are shown in Table 6 which indicates the curvature radii R of the curved portions $C_I$, $C_I$ and curved portions $C_O$, $C_O$, and the number n of frays which occurred per 12,000 m of the interlaced yarn T.

For the purpose of measuring the number of frays, Fray Counter Model DT-104 (manufactured by Toray Industries, Inc.) was used.

TABLE 6

| | Ex. 5 | Ex. 6 | Ex. 7 | Com. 5 | Com. 6 | Com. 7 |
|---|---|---|---|---|---|---|
| R | 5.0 | 2.0 | 1.0 | 0.5 | 0.3 | Chamfered |
| n | o | o | o | Δ | x | x |

Ex.: Example
Com.: Comparative Example
o: 1 or less fray
Δ: 2 to 5 frays
x: 6 or more frays As is clear from Table 6 above, according to the apparatus for treating yarn with fluid of the example, the number of frays occurring in the yarn T interlaced can be reduced.

At the time of interlacing, in the apparatus for treating according to the examples, the compressed air ejected through the fluid conduits 11*d* was discharged along the thread path at between the plates 11 and 12, while it was discharged along the curved surfaces of the curved portions $C_I$ and $C_O$ in a direction away from the running direction of the yarn at the curved portions $C_I$, $C_I$ and curved portions CO, $C_O$. This prevented the yarn T to be treated from jumping out of the treating region between the nozzle plate 11 and the presser plate 12, the thread path from being disturbed, and the yarn T from loosening.

On the other hand, in the apparatus for treating in the comparative examples, the compressed air ejected through the fluid conduits 11*d* and 11*d* was discharged in the running direction of the yarn, and especially at the incoming and outgoing portions of the plates 11 and 12, the thread path was disturbed by the compressed air discharged.

EXAMPLES 8 TO 10

Comparative Examples 8 to 10

Using the apparatus for treating yarn with fluid, which has the V groove 11*e* shown in FIG. 16 and FIG. 17, the POY consisting of 36 filaments and a total denier of 75 was interlaced under the same conditions as those used for the examples 5 to 7 and the comparative examples 5 to 7 described above, and the number n of the generated frays was measured in the same way as previously described.

The results are shown in Table 7 which indicates the curvature radii R of the curved portions $C_I$, $C_I$ and curved portions $C_O$, $C_O$, and the number n of the frays generated per 12,000 m of the interlaced yarn T in the same manner as previously described.

TABLE 7

| | Ex. 8 | Ex. 9 | Ex. 10 | Com. 8 | Com. 9 | Com. 10 |
|---|---|---|---|---|---|---|
| R | 5.0 | 2.0 | 1.0 | 0.5 | 0.3 | Chamfered |
| n | o | o | o | Δ | x | x |

Ex.: Example
Com.: Comparative Example
o: 1 or less fray
Δ: 2 to 5 frays
x: 6 or more frays As is clear from Table 7 above, the apparatus for treating yarn with fluid which has the V groove 11*e* formed in the running direction of the yarn T also ensures stable thread path for the yarn T and provides the effect of controlling the generation of frays.

What is claimed is:

1. An apparatus for treating yarn with a fluid, which apparatus is designed to provide a yarn consisting of multifilaments having cohesion using a working fluid, comprising:

(A) a first component comprising:
  (1) a flat surface;
  (2) at least two fluid conduits extending through said first component and opening into said flat surface; wherein the axes of said fluid conduits are inclined at an angle (θ) with respect to each other and cross on the extended lines thereof; and
  (3) a concave portion having a depth (b) and disposed along the entire length of said flat surface between said openings of said fluid conduits; and (B) a second component parallel to said first component, comprising a flat surface opposing said flat surface of said first component and separated therefrom by a gap (G); wherein said gap (G) is in the range of 0.2 mm to 5.0 mm, inclusive, and wherein said depth (b) is such that $0.5 \leqq (b)/(G) \leqq 1.5$, thereby providing the filaments of the yarn running through the gap along the concave portion with cohesion, by ejecting a working fluid with a specified pressure from said openings of said fluid conduits.

2. The apparatus for treating yarn with fluid according to claim 1, wherein said concave portion has a V-shaped groove.

3. The apparatus for treating yarn with fluid according to claim 1, wherein a width (w) of said concave portion ranges from 2 to 10 mm.

4. The apparatus for treating yarn with fluid according to claim 1, wherein said at least two fluid conduits have a pitch (P) in millimeters on the flat surface of said first component, the pitch being set to satisfy the following formula when the size of said yarn is taken as De:

$$P=\log_{10}De-5\log_{10}De$$

5. The apparatus for treating yarn with fluid according to claim 1, wherein the pitch (P) of said at least two fluid conduits on the flat surface of said first component is between 1 mm and 20 mm, inclusive.

6. The apparatus for treating yarn with fluid according to claim 1, wherein said at least two fluid conduits have a diameter which ranges from 0.5 to 3.0 mm.

7. The apparatus for treating yarn with fluid according to claim 1, wherein said specified crossing angle (θ) of said at least two fluid conduits ranges from 60 to 160 degrees.

8. The apparatus for treating yarn with fluid according to claim 1, wherein the pressure of said working fluid ranges from 0.3 to 10 $kgf/cm^2$.

9. The apparatus for treating yarn with fluid according to claim 1, wherein said first and second components are made of a ceramic.

10. The apparatus for treating yarn with fluid according to claim 1, wherein said first and second components are provided with curved portions at either the sides where the yarn enters, or the sides where the yarn exits, the curved portions functioning to guide the working fluid ejected from said at least two fluid conduits so that it is discharged in a direction away from the running direction of said yarn.

11. The apparatus for treating yarn with fluid according to claim 10, wherein said curved portions have a curvature radius of 1 mm or more but 50 mm or less.

12. The apparatus for treating yarn with fluid according to claim 10, wherein the pitch (P) in millimeters of said at least two fluid conduits on the flat surface of said first component is set to satisfy the following formula when the size of said yarn is taken as De:

$$P=\log_{10}De-5\log_{10}De$$

13. The apparatus for treating yarn with fluid according to claim 10, wherein the pitch (P) of said at least two fluid conduits on the flat surface of said first component is from 1 to 20 mm inclusive.

14. The apparatus for treating yarn with fluid according to claim 10, wherein said at least two fluid conduits have a diameter which ranges from 0.5 to 3.0 mm.

15. The apparatus for treating yarn with fluid according to claim 10, wherein said specified crossing angle (θ) of said at least two fluid conduits ranges from 60 to 160 degrees.

16. The apparatus for treating yarn with fluid according to claim 10, wherein the pressure of said working fluid ranges from 0.3 to 10 $kgf/cm^2$.

17. The apparatus for treating yarn with fluid according to claim 10, wherein said first and second components are made of a ceramic.

* * * * *